US007690071B1

(12) United States Patent
Prohoroff

(10) Patent No.: US 7,690,071 B1
(45) Date of Patent: Apr. 6, 2010

(54) ROTARY BRUSH APPARATUS

(76) Inventor: Phillip W. Prohoroff, 13589 W. Holly St., Goodyear, AZ (US) 85338

( * ) Notice: Subject to any disclaimer, the term of this patent is extended or adjusted under 35 U.S.C. 154(b) by 1062 days.

(21) Appl. No.: 11/373,421

(22) Filed: Mar. 10, 2006

(51) Int. Cl.
*A46B 13/02* (2006.01)

(52) U.S. Cl. ..... 15/180; 15/87

(58) Field of Classification Search ..... 15/87, 15/180, 202
See application file for complete search history.

(56) References Cited

U.S. PATENT DOCUMENTS 1,564,226 A * 12/1925 Finnell ..... 15/180
2,853,729 A * 9/1958 Link ..... 15/180
2,917,767 A * 12/1959 Lechene ..... 15/180
3,101,501 A * 8/1963 Horton et al. ..... 15/180
3,678,530 A * 7/1972 Horton et al. ..... 15/180
3,758,908 A * 9/1973 Maltarp ..... 15/180
3,766,589 A * 10/1973 Arenas ..... 15/180
3,875,607 A * 4/1975 Rosseau ..... 15/180
4,765,013 A * 8/1988 Lowe ..... 15/180
4,854,002 A * 8/1989 Smith ..... 15/176.6
5,737,793 A * 4/1998 Prohoroff ..... 15/180
6,026,533 A * 2/2000 Prohoroff ..... 15/180

* cited by examiner

*Primary Examiner*—Randall Chin
(74) *Attorney, Agent, or Firm*—H. Gordon Shields

(57) ABSTRACT

A plate for a brush apparatus for a street sweeper has an alignment hole which is used to align a brush segment for securing the brush segment to the plate. A clamp assembly moves downwardly to allow a used brush segment to be removed and moves upwardly to secure a brush segment to the plate. Rotation of a bolt, the head of which is on the top of the plate, moves the clamp assembly upwardly and downwardly. An alignment hole in the brush segment is aligned with the alignment hole in the plate. A pin on the clamp assembly extends into the alignment hole in the brush segment. Shelf elements on the bottom of the plate help hold brush segments.

12 Claims, 2 Drawing Sheets

ROTARY BRUSH APPARATUS

BACKGROUND OF THE INVENTION

1. Field of the Invention

This invention relates to rotary brushes, and, more particularly to a rotary brush assembly for holding rotary brush segments to a plate.

2. Description of the Prior Art

U.S. Pat. Nos. 5,737,793 and 6,026,533, the patentee of which is the inventor hereof, represent second generation elements for rotary brush assemblies. The present invention comprises the third generation elements for rotary brush assemblies.

Rotary brushes are used in street sweeping equipment at the outer portions of the equipment for moving trash, dirt, leaves, and other items to be swept inwardly so that large cylindrical brushes or vacuum suction may move the items into an internal storage compartment within the sweeper. The rotary brushes include brush segments secured to a plate. The brush segments wear out and must be changed periodically. The brush segments typically weigh about twenty pounds, and are changed on the plates in place on the sweepers. The above cited second generation prior art saves time and manpower over the first generation brush apparatus, and the present invention, third generation rotary brush apparatus saves time and manpower over the second generation brush apparatus. Brush segments of the present invention are easily changed by only a single individual and are secured to a plate by a central bolt on a clamp assembly and a second bolt may be used to insure a secure fastening of a segment.

SUMMARY OF THE INVENTION

The invention described and claimed comprises a brush assembly for a rotary sweeper, including a plate for holding a plurality of brush segments and a clamp assembly for securing a brush segment to the plate. The plate includes an index or alignment hole, and the brush segment includes an index or alignment hole aligned with the index hole in the plate. The clamp assembly includes a pin which extends into the index hole of the brush segment. The bottom of the plate includes stop and alignment elements for the clamp assembly and the brush segment. A brush segment is secured to the plate by a single bolt, the rotation of which moves the clamp assembly downwardly to allow a used brush segment to be removed and upwardly to secure a new brush segment to the plate.

Among the objects of the present invention are the following:

To provide a new and useful rotary brush assembly;

To provide a new and useful plate rotatable on a sweeper;

To provide a new and useful brush segment for a rotary brush assembly;

To provide a new and useful clamp assembly for securing a brush segment to a plate;

To provide a new and useful brush segment and a plate having a clamp assembly for securing the brush segment to the plate;

To provide a new and useful rotary brush assembly including a plate having an alignment aperture and a rotary brush segment having an alignment aperture aligned with an alignment aperture in the plate;

To provide a new and useful rotary brush assembly having alignment and shelf support elements for holding a brush segment;

To provide a new and useful clamp assembly for securing a brush segment to a plate and having a pin which extends into an alignment aperture in the brush segment.

DESCRIPTION OF THE PREFERRED EMBODIMENT

Figure 1:
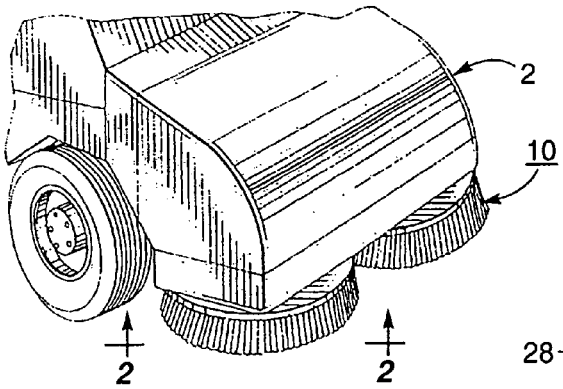
FIG. 1 is a perspective view of a portion of a street sweeper representing the use environment of the present invention.

FIG. 1 is a schematic perspective representation of the front portion of a street sweeper 2, the use environment of the present invention. On the front sides of the sweeper 2 are two rotating gutter brushes 10. One gutter brush is on each side of a center cylindrical brush. Trash or items to be swept from the sides of the vehicle 2 are moved by the brushes 10 towards the center where the cylindrical brush sweeps the material upwardly and into a collection area. The brush 10 of the present invention, as shown best in FIG. 2, includes four segments secured to a round or circular carrier plate 12. The carrier plate 12 includes a top side 14 and a bottom side 16, and the brush segments are secured to the bottom side 16. The brush segments wear out and must be changed periodically. The present invention allows the brush segments to be changed quickly and easily. Bristles for the brush segments are schematically illustrated in FIG. 2, but have been omitted for clarity in FIG. 4.

Figure 2:
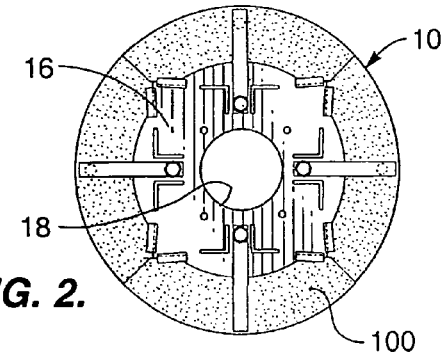
FIG. 2 is a bottom view taken generally along line 2-2 of FIG. 1.
Figure 3:
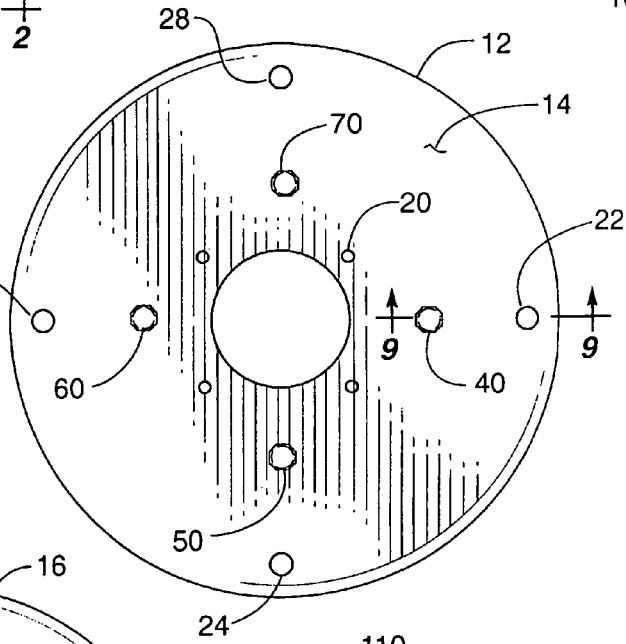
FIG. 3 is a plan view of the top of a rotary brush holding plate.
Figure 4:
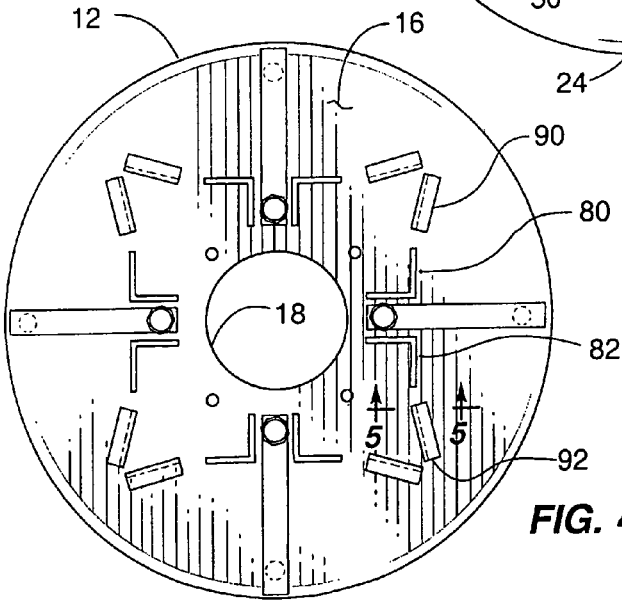
FIG. 4 is a plan view of the bottom of the brush holding plate of FIG. 2.

FIG. 2 is a bottom plan view of a gutter brush 10 showing four brush segments secured to the carrier plate 12. FIG. 3 is a plan view of the top side 14 of the carrier plate 12, and FIG. 4 is a plan view of the bottom side 16 of the carrier plate 12. For the following discussion, reference will be made to FIGS. 1, 2, 3, and 4.

Typically, there are four or five brush segments to a brush, with the size or diameter of the carrier plate determining whether there are four or five segments to a brush. For illustrative purposes, the carrier plate 12 shown in the drawing figures and discussed herein uses four brush segments. The brush segments will be discussed below in detail in conjunction with FIGS. 7 and 8.

The plate 12 includes a center hole 18, and disposed about the hole 18 are shown a plurality of fastening holes 20. The fastening holes 20 are used to secure the plate 12 to a pump which provides power for rotating the brushes 10. There are also four alignment holes 22, 24, 26, and 28 disposed symmetrically on the plate slightly inwardly from the outer periphery of the plate 12. The holes 22 . . . 28 are used to align brush segments to the plate 12.

Figure 9:
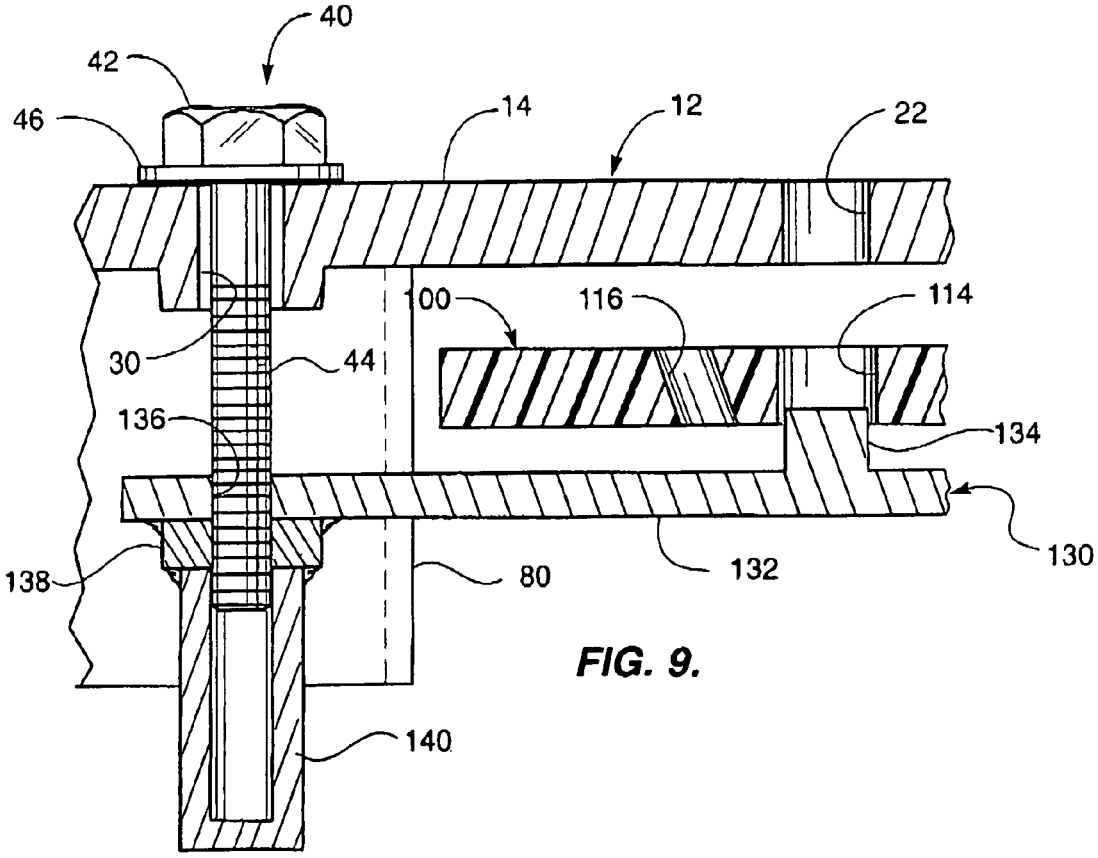
FIG. 9 is a view in partial section through a portion of the present invention taken generally along line 9-9 of FIG. 3.

Aligned radially with the alignment holes are four bolt holes which receive bolts that help to secure the brush segments to the plate 12. One of the bolt holes, a hole 30, is shown in FIG. 9 and will be discussed below in conjunction with FIG. 9. A bolt 40 is shown extending through the hole 30. The heads of three other bolts are also shown in FIG. 3. The bolts include bolts 50, 60, and 70, in addition to the bolt 40.

On the bottom 16 of the plate 12 are stop and alignment elements for the brush segments. There are a pair of stop and alignment elements 80 and 82 shown in FIG. 4 for guiding and aligning a clamp assembly 130 (see FIG. 9) to the plate 12. There are four such clamp assemblies for helping to secure the four brush segments to the plate 12. The stop and alignment elements 80 and 82 comprise angle iron elements appropriately secured, as by welding, to the bottom side 16 of the plate 12. The portions of the elements 80 and 82 which comprise guide and stop elements are parallel plates of the angle iron elements. The elements 80 and 82 are appropriately spaced apart to allow a clamp assembly to move easily, but at the same time the parallel plate elements confine the clamp assembly to generally up and down movement with minimum side to side or transverse movement.

There are also a pair of stop and support shelf elements 90 and 92 for each brush segment. The stop and support shelf elements 90 and 92 are disposed adjacent to the stop and alignment elements 80 and 82. The pair of stop and support shelf elements include the elements 90 and 92 adjacent to the stop and alignment elements 80 and 82, respectively. The stop and support shelf elements 90 and 92 also comprise angle iron elements also appropriately secured, as by welding, to the bottom surface 16.

Figure 5:
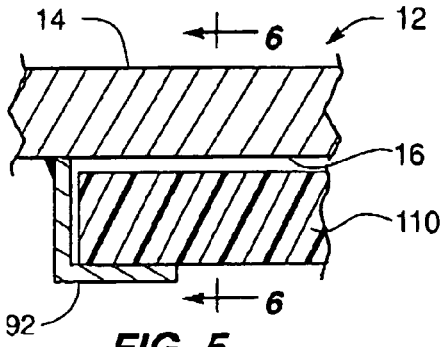
FIG. 5 is a fragmentary view in partial section of a portion of the apparatus of the present invention taken generally along line 5-5 of FIG. 4.
Figure 6:
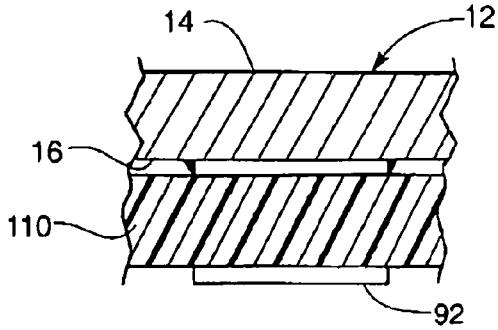
FIG. 6 is a view in partial section taken generally along line 6-6 of FIG. 5.

The elements 90 and 92 are oriented differently on the plate 12 from the orientation of the elements 80 and 82. The orientation of the elements 90 and 92 are best shown in FIGS. 5 and 6. FIG. 5 is a view in partial section taken generally along line 5-5 of FIG. 4, and with a portion of a brush segment 100 shown disposed on the shelf portion of element 92. FIG. 6 is a view in partial section taken generally along line 6-6 of FIG. 5, also with a portion of the brush segment 100 disposed on the shelf portion of element 92.

Figure 7:
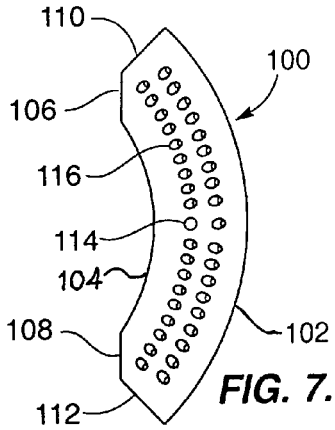
FIG. 7 is a plan view of a portion of the present invention.

FIG. 7 is a plan view of the brush segment 100. The brush segment 100 has an arcuate configuration, with an outer arcuate periphery 102 and an inner arcuate periphery 104. At the outer ends of the segment 100 are four generally flat end portions, inner end portions 106 and 108 and outer end portions 110 and 112. The outer arcuate periphery 102 of the brush segment 100 generally conforms to the same arcuate configuration as the outer arcuate periphery of the plate 12.

Disposed inwardly between the outer arcuate periphery 102 and the inner arcuate periphery 104 and generally centered between the outer ends of the segment is an alignment hole or aperture 114. There is shown in FIG. 7 two arcuate rows of bristle receiving holes 116. The bristle receiving holes or apertures 116 are generally parallel to each other, and they generally follow the arcuate configuration of the segment 100. The alignment hole or aperture 114 is disposed adjacent to the bristles receiving holes 116.

FIG. 9 is a view in partial section showing the clamp assembly 130 relative to the plate 12 and the brush segment 100. The bristle receiving holes 116 are shown in FIG. 9 extending diagonally through the segment 100.

The clamp assembly 130 includes a bar 132 disposed between the guide elements 80 and 82. The bolt 40 is shown extending through an aperture 30 in the plate 12. The bolt 40 includes a hex head 42 and a threaded shank 44 extending downwardly and through a hole 136 in the bar 132. A washer 46 is disposed beneath the head 42 of the bolt 40. Secured coaxially with the hole 136 is a nut 138. The nut 138 is appropriately secured, as by welding, to the bottom of the bar 132. As the bolt 40 is turned or rotated, the bar 132 moves upwardly to clamp the segment 100 to the bottom 16 of the plate 12 and downwardly to release the segment 100 for replacing the segment. The bar 132 is, as discussed above, constrained by the guide plate elements 80 and 82.

Beneath the bar 132 and coaxially aligned with the hole 136 is a sleeve 140. The sleeve 140 serves to protect the threaded shank 44 of the bolt 40 from accumulating dust and debris. The environment of a street sweeper is not clean, but rather is dusty and dirty, and to prevent the shank 44 from getting dirty and gritty and difficult to rotate, the sleeve 140 is secured to the bar 132 beneath the nut 138.

The bar 132 includes a pin 134 which extends upwardly and extends into the alignment hole or aperture 114 of the segment 100. Note that the alignment aperture 22, the aperture 114, and the pin 134 are appropriately aligned with each other.

Referring again to FIGS. 5 and 6, as well as to FIG. 9, the clamping of a brush segment to the plate 12 may be understood. The head 42 of the bolt 40 is rotated to move the clamp assembly 130 downwardly to allow a worn brush segment to be removed from a carrier plate. A new brush segment 100 is then moved beneath the plate 12 until the hole 114 is aligned with the aperture 22. The segment is then partially disposed on the shelf support elements 90 and 92 and against the elements 80 and 82. The bolt 40 is then rotated to move the bar 132 upwardly to clamp the segment securely to the plate 12. The pin 134 extends into the aperture 114 in the segment 100 to help secure the segment to the plate.

As may be understood from FIG. 7, when the bolt 40 is rotated to clamp the segment 100 to the bottom of the plate 12, the segment 100 tilts slightly upwardly from the shelf elements. Due to the nature of the use environment of the apparatus of the present invention, close tolerances are not of great concern. Thus, rather than have tight fit between the shelf portions of the angle iron elements and the thickness of the segment 100, there is sufficient clearance to permit easy removal and insertion of brush segments.

Figure 8:
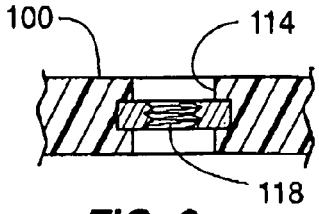
FIG. 8 is a fragmentary view in partial section of an alternate embodiment of a portion of the present invention.

Referring to FIG. 8, a nut 118 may be molded into the hole 114 if desired to allow another bolt (not shown) to be used to help secure the brush segment to the plate 12. The alignment hole 22 then becomes also a bolt receiving hole after the segment is appropriately aligned with the hole 22 and the pin 134 of the clamp assembly 130. The extra bolt may contribute to the securing of a brush segment.

Note from FIG. 3 that the bolts of the clamping assemblies and the alignment apertures are also radially aligned. This radial alignment helps in changing a segment if a second bolt is desired for added securement. The plate 12 need not be rotated or turned in order to secure a segment whether one or two bolts is desired for a securing segment. At the same time, both bolts may be easily accessed for removing a segment.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Brush apparatus comprising in combination:

a carrier plate having a top side, a bottom side for receiving a brush segment, and an outer periphery;

a pair of stop and support shelf elements extending downwardly from the bottom side of the carrier plate for stopping and supporting a brush segment;

a first aperture extending through the carrier plate inwardly from the outer periphery;

a second aperture extending through the carrier plate inwardly from, and aligned with, the first aperture;

a bolt extending through the second aperture for securing a brush segment to the carrier plate;

a clamp assembly disposed beneath the carrier plate including a bar, a pin extending upwardly on the bar and aligned with the first aperture, and a threaded portion on the bar for receiving the bolt for moving the bar upwardly and downwardly;

means for guiding the clamp assembly upwardly and downwardly; and a brush segment disposed between the bottom of the carrier plate and the bar of the clamp assembly and on and against the pair of stop and support shelf elements whereby upward movement of the clamp assembly by rotation of the bolt secures the brush segment to the carrier plate.

2. The brush apparatus of claim 1 in which the brush segment includes an alignment aperture aligned with the first aperture in the carrier plate and the pin on the clamp assembly bar extends into the aperture in the brush segment.

3. The brush apparatus of claim 1 in which the means for guiding the clamp assembly upwardly and downwardly includes a pair of guide plates extending downwardly from the bottom side of the carrier plate, and the bar is disposed between the guide plates.

4. The brush apparatus of claim 1 in which the carrier plate includes a stop element for the brush segment.

5. The brush apparatus of claim 1 in which the clamp assembly further includes a sleeve for receiving a portion of the bolt.

6. The brush apparatus of claim 1 in which the pair of stop and support shelf elements are spaced apart from the clamp assembly and against which the brush segment is disposed when the alignment aperture in the brush segment is aligned with the first aperture in the carrier plate.

7. Brush apparatus for a sweeper including in combination:

a plate securable to a sweeper for rotation and including a top side, a bottom side, an outer periphery, a first aperture extending through the plate adjacent to the outer periphery, a second aperture extending through the plate radially aligned with and spaced apart from the first aperture;

a clamp assembly movable upwardly and downwardly from the bottom side of the plate, and including a bar, and a pin extending upwardly on the bar and aligned with the first aperture in the plate;

a pair of stop and support shelf elements extending downwardly from the bottom side of the plate for supporting a brush segment;

a brush segment disposed between the bottom side of the plate and the clamp assembly; and means for moving the clamp assembly upwardly and downwardly.

8. The brush apparatus of claim 7 in which the means for moving the clamp assembly upwardly and downwardly includes a bolt extending through the second aperture in the plate.

9. The brush apparatus of claim 8 which further includes a threaded portion on the clamp assembly for receiving a portion of the bolt extending through the second aperture in the plate.

10. The brush apparatus of claim 7 in which the brush segment includes an alignment aperture for receiving the pin of the clamp assembly.

11. The brush apparatus of claim 7 which further includes means for guiding the clamp assembly upwardly and downwardly.

12. The brush apparatus of claim 11 in which the means for guiding the clamp assembly upwardly and downwardly includes a pair of guide plates secured to the bottom side of the plate, and the bar is disposed between the pair of guide plates.

* * * * *